US006053374A

United States Patent [19]

Santagiuliana

[11] Patent Number: 6,053,374

[45] Date of Patent: Apr. 25, 2000

[54] DOSING CAP FOR DISPENSING LIQUIDS

[75] Inventor: Evans Santagiuliana, Vicenza, Italy

[73] Assignee: Taplast, Dueville, Italy

[21] Appl. No.: 09/171,652

[22] PCT Filed: Apr. 22, 1996

[86] PCT No.: PCT/EP96/01678

§ 371 Date: Oct. 22, 1998

§ 102(e) Date: Oct. 22, 1998

[87] PCT Pub. No.: WO97/39962

PCT Pub. Date: Oct. 30, 1997

[51] Int. Cl.[7] ..... B65D 47/26

[52] U.S. Cl. ..... 222/534; 222/531

[58] Field of Search ..... 222/536, 534, 222/531

[56] References Cited

U.S. PATENT DOCUMENTS 3,734,359 5/1973 Waterman .

FOREIGN PATENT DOCUMENTS 0 386 475 A1 9/1990 European Pat. Off. .

*Primary Examiner*—Gregory L. Huson

*Attorney, Agent, or Firm*—Watson Cole Grindle Watson, P.L.L.C.

[57] ABSTRACT

The invention is a plastic cap for liquid containers, comprising a main body, which is essentially cylindrical, and an element (20) for dispensing the liquid. The upper part of said dispensing element is essentially circular, level and hinged to the main body, while its lower part is socle-shaped and is characterized by a partially cylindrical base surface (27), covered by a layer of soft material (270) sliding in the corresponding groove (30) belonging to the main body (1). Said layer of soft material (270) serves as a seal when the dispenser is open. When, on the other hand, the dispenser is closed the cylindrical projection (8) of the hole (7) of the main body, coupled with the layer of soft material (270) present on the socle, fits into the groove (30) in such a way as to ensure the seal between the dispenser and the cap body in any case.

10 Claims, 2 Drawing Sheets

DOSING CAP FOR DISPENSING LIQUIDS

BACKGROUND OF THE INVENTION

The invention concerns a cap provided with dispenser, particularly suitable for being applied to bottles containing liquids such as cosmetics, liquid soaps. shampoos, tanning creams or alike.

The present description illustrates only one kind of use among many of the cap object of the invention.

The market offers caps for containers of liquids like cosmetics, shampoos or creams, the operation of which essentially consists in the fact that the cap itself comprises a liquid dispenser that can be operated by the user. One of the known caps, for example, is provided on its top with a hinged plastic insert with a hole and with horizontal axis, so that when the insert is in horizontal position the liquid cannot flow out of the bottle, on the contrary, when the insert is in vertical position the hole present on the cap bottom and in contact with the bottle neck is connected to the channel present on the vertical insert, which makes the liquid flow out of the bottle. As the bottom of this insert is cylindrical and rotates on a likewise cylindrical surface where the liquid outlet is provided, when the cap is closed the seal is ensured. The limitations of the just described cap consist in the fact that both hands are necessary to open and close the dispenser, one hand to hold the bottle and the other to operate the rotary insert.

Another kind of cap, used in the cosmetic sector, comprises an essentially cylindrical body with a vertical hole and a practically disc-shaped upper element. A lower pipe for conveying the liquid is connected to the hole present on the cylindrical body. The upper element is hinged to the cylindrical body and is capable of rotating of a given angle due to the fingers' pressure. When the upper element is in horizontal position, it keeps the small pipe belonging to the central body, out of which the liquid should flow, closed. When, on the contrary, the upper element is pushed by the finger and is positioned obliquely the small pipe belonging to the central body and the channel present in the rotary element are connected with each other.

Whereas this kind of cap can be opened and closed with one hand only, by simply grasping the bottle, on the other hand it presents the drawback that it is not suitable for dispensing liquids with low density, since the seal of the whole system is not guaranteed and therefore the liquid may flow out of the container even when the cap is closed, or it may also flow out of the rim between the cap body and the rotary element.

Another cap is known, which was meant to eliminate the above mentioned drawbacks and which was patented in Italy on Apr. 17, 1992 and registered with n 1233820.

This cap is characterized by an improved seal, which however is not safe in any condition of use.

U.S. Pat. No. 3,734,359 discloses a plastic cap for dispensing liquid wherein the dispensing element rotably connected to the main body of the cap presents a socle with a semi-soft resilient plastic material molded into one of the abutting arcuate surface for the purpose to improve he seal of said cap.

SUMMARY OF THE INVENTION

The present invention aims at eliminating all the above mentioned inconveniences.

A further goal is the implementation of a cap with perfect seal even in difficult conditions, like for example on airplanes, where the pressure in the passenger compartment is slightly lower than the atmospheric pressure on the ground. All the goals mentioned above and others that will be better highlighted here below are achieved through the implementation of a cap for liquid containers.

One of the advantages ensured by this kind of cap is represented by the fact that either when it is open and when it is closed the seal is always perfect, owing to the presence of the layer of soft material on the partially cylindrical base of the socle.

In the first instance the seal is between the hole made on the main element and positioned on the concave surface of the main cylindrical body and the hole made on the conveying channel.

When the cap is closed the annular projection present on the hole of the concave surface of the main cylindrical element is superimposed to the layer of soft material of the socle of the dispensing element, so that the sealing effect is ensured even in this condition.

A further advantage consists in the fact that this cap can be opened and closed with just one finger of the hand that holds the container, with no need to use the other hand.

This is particularly important, since it facilitates the use of the bottle/container in the most different situations, without problems for the user.

BRIEF DESCRIPTION OF THE DRAWINGS

Further advantages and characteristics of the invention will be better highlighted in the description of a favourite application among many of the cap, illustrated in the attached drawings, wherein.

DESCRIPTION OF THE INVENTION

With reference to the figures indicated above, it can be observed that the cap object of the invention, indicated as a whole by 10, comprises an essentially cylindrical body indicated by 1 and having two coaxial walls, where the outer wall is indicated by 2 and the inner and shorter wall is indicated by 3.

Figure 1:
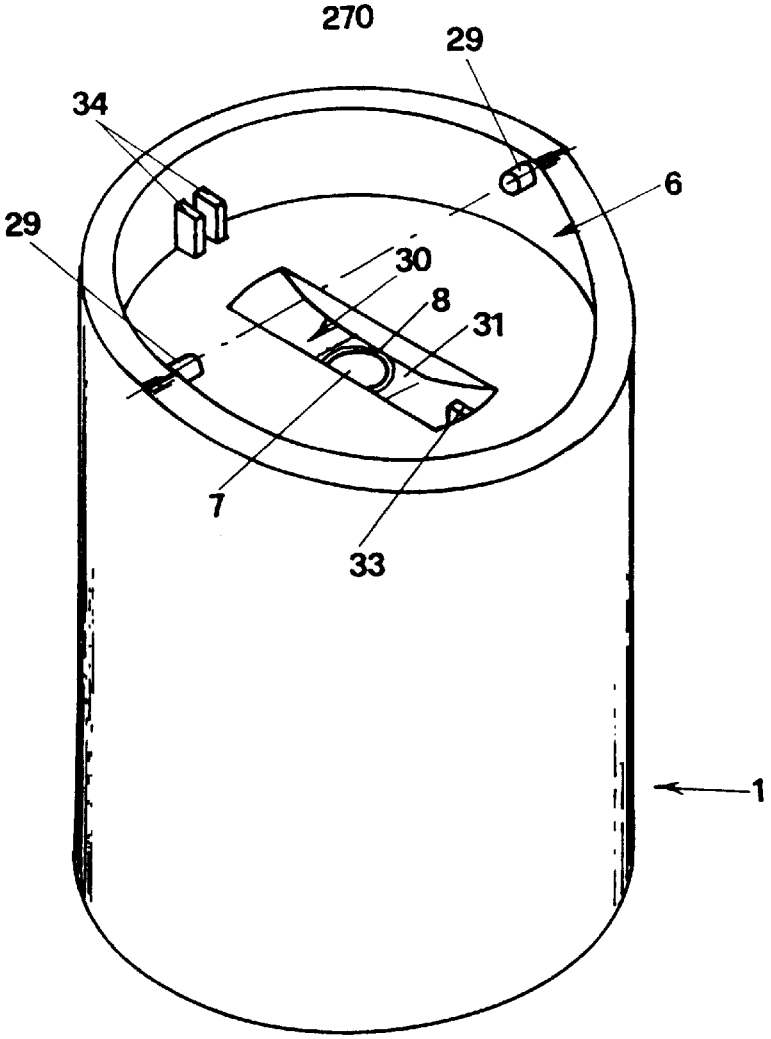
FIG. 1 is a perspective view of the main body of the cap.

The threading 4 belonging to the inner wall 3 engages with the corresponding threading present on the container 5 screwed on the cap 10. In the upper connection between the cylindrical surface 3 and the cylindrical surface 1 there is a concave connecting surface indicated by 6, the concave side of which faces the outer part of the cap visible in FIG. 1. Said concave surface is provided with a hole positioned almost centrally, indicated by 7, the rim of which is provided with an annular projection 8.

The concave surface is also provided with a groove indicated by 30, in which the socle of the dispensing element 20 slides, said groove being provided with a level bottom 31 near the hole 7 and the annular projection 8.

Said level bottom and said annular projection ensure the seal between the layer of soft material 270 of the socle of the dispensing element and the body of the cap 1.

The seal between the body 1 and the container 5 is obtained through the sealing ring 61 that is provided with a first part with truncated-cone-shaped profile connected to a cylindrical part.

Further, near the ends of the groove there are, in opposite positions with respect to the hole 7 and along the longitudinal axis of the groove 30, a projection 33 and a pair of projections 34, respectively, all serving as an end-of-stroke of the socle 27 of the dispensing element when the cap is open or closed, respectively.

Figure 2:
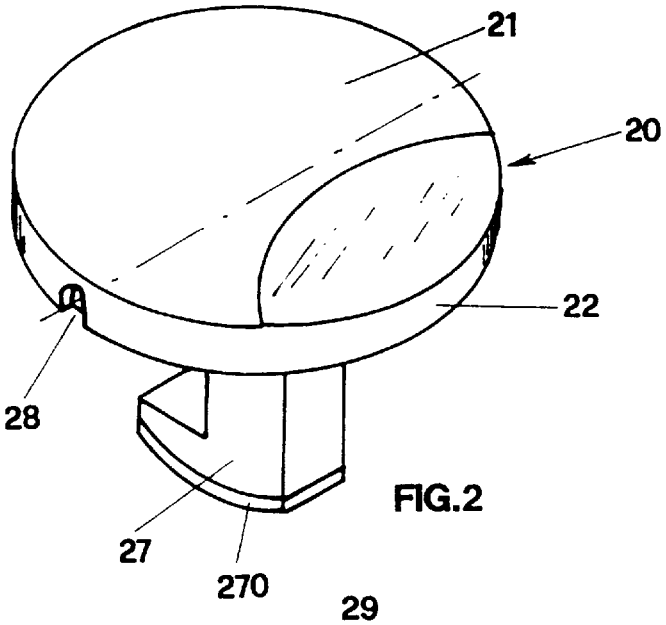
FIG. 2 is a perspective view of the dispensing element that is connected to the upper part of the cap.
Figure 3:
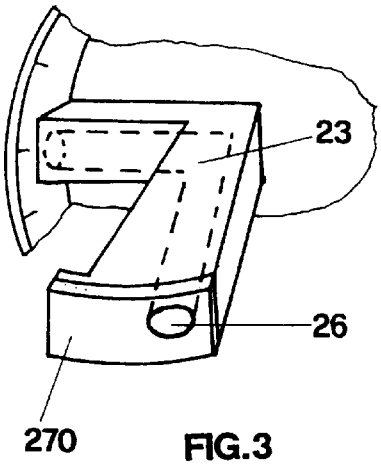
FIG. 3 is a perspective view of the bottom of the dispensing element socle.

The dispensing element, indicated as a whole by 20, comprises an upper disc-shaped part indicated by 21, with an edge 22 under which a channel indicated as a whole by 23 is provided. Said channel is substantially shaped as a right angle and has a first vertical length 24 and a second length 25 tangential to the lower surface of the disc 21; the vertical length 24 ends with a hole 26 belonging to a cylindrical, socle-shaped base 27 with generating lines parallel to the rotation axis of the dispensing element 20 that in turn is provided with two grooves 28, one of which can be observed in FIG. 2. Said grooves can house two corresponding cylindrical projections 29 visible in FIG. 1, on which the dispensing element 20 rotates.

According to the invention, the base 27 of the socle of the dispensing element 20 is provided with a layer of soft plastic material 270. To advantage, this layer can be coupled with the socle 27 during the injection molding of the socle itself. To obtain this, after injecting hard plastic material, for example polypropylene, to mold the dispensing element 20, it is sufficient to carry out a further injection of soft plastic material near the socle, before the dispensing element has hardened and therefore before opening the mold for the extraction of the piece. This process is known as co-injection molding.

Figure 4:
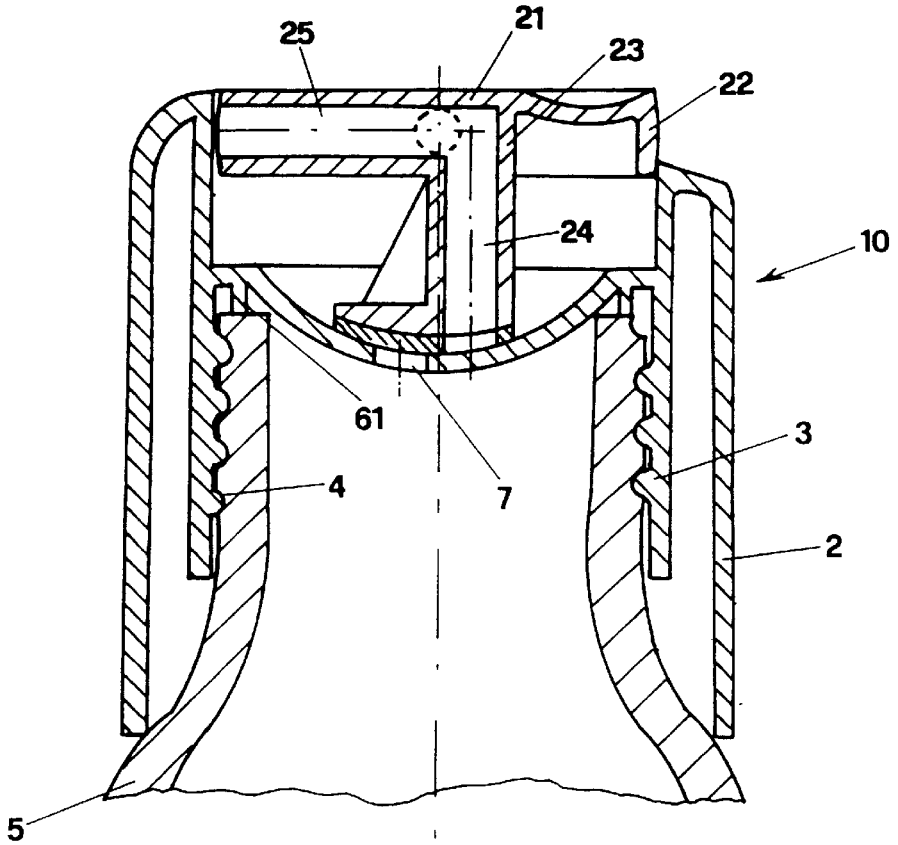
FIG. 4 shows a section of the cap in its entirety, comprising a main cylindrical body and a dispensing element, with closed dispensing element.
Figure 5:
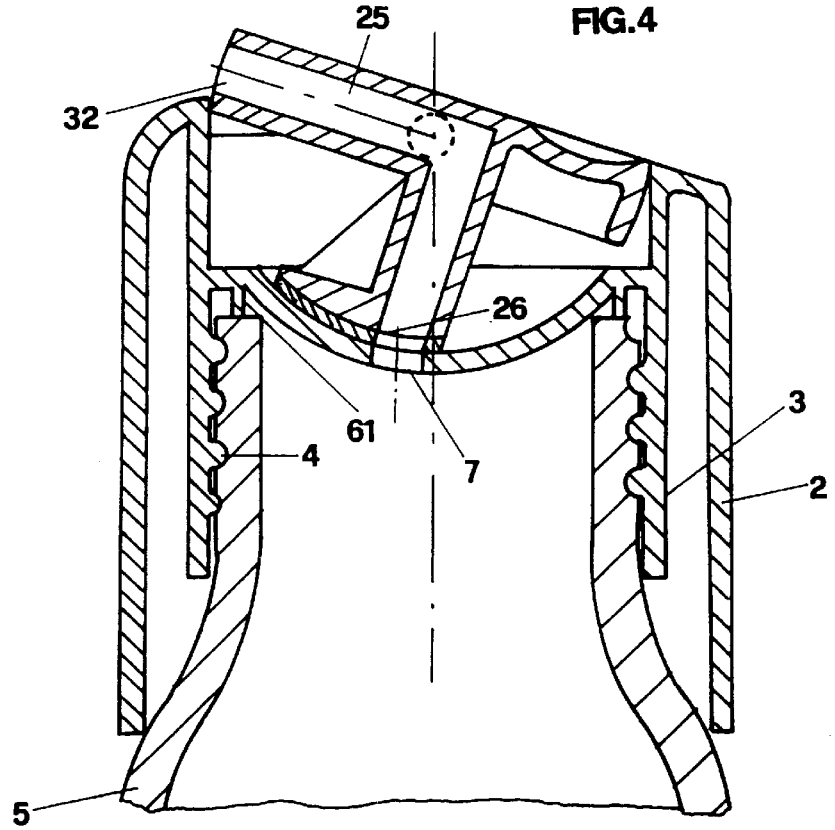
FIG. 5 shows a section of the cap object of the invention with open dispensing element.

When, by exerting pressure on the impression 31 on the dispensing element 20, the rotation of said dispensing element is obtained, as shown in FIG. 5, the conveying channel 23 is connected to the hole 7 and therefore the liquid contained in the bottle 5 flows out of the hole 32. In this regard it can be observed that the pair of projections 33 ensures the correct position of the dispensing element 20 and ensures also the fitting of the annular projection 8 into the hole 26 belonging to the channel length 24. In this way all the liquid flows out of the hole 32 without dispersing in the space created between the concave surface 6 and the lower part of the dispensing element 20. This is due to the fact that the layer of soft material 270 creates a sealed area around the projecting rim 8 of the hole 6. When, on the contrary, the cap is closed, as shown in FIG. 4, the correct closing is ensured by the interference between the projecting rim 8 and the layer of soft material 270.

As explained above, the cap object of the invention achieves all the set goals, since the obtained cap not only can be operated easily and with one hand, but ensures perfect sealing both in open and closed position and in any condition of use; when the cap is open the liquid just flows out of the hole made in the dispensing element, while the closed cap seals the bottle neck and the hole made in the cap itself and connected with the dispenser.

What is claimed is:

1. A plastic cap for dispensing liquids from a bottle, comprising a cylindrical main body adapted to be secured to the bottle along a central axis, said main body having an upstanding side wall and an upper surface with a concave groove formed therein, said upper surface having a hole formed therein located in the groove a dispensing element slidable in the groove and having a side wall portion for engaging the upstanding side wall, said dispensing element being rotatably connected to said body between open and closed positions around an axis perpendicular to the central axis of said body and having an upper part hinged to the main body and a depending portion including a socle formed with a convex surface for conformably engaging the concave groove, said dispensing element having a through channel extending from an opening in the convex surface of the socle to an opening in the side wall portion, the convex surface of said socle including a layer of soft material for interacting with the convex surface to ensure the sealing of said dispensing cap, first and second projections disposed along a longitudinal axis of the groove within the body, said first and second projections for defining rest positions of the socle to establish respective opening and closing positions of the cap.

2. A cap according to claim 1 wherein the main body is formed of relatively rigid injected polypropylene and the layer of soft material comprises a co-injected, relatively soft plastic material.

3. A cap according to claim 1 wherein the channel in the dispensing element is formed of a first length extending along the upper port in a first direction and a second length extending along the depending portion in a second direction perpendicular thereto.

4. The cap according to claim 1 further comprising a depending sealing ring formed in the main body for engaging an upper portion of the bottle and for sealing the cap relative to the bottle.

5. A plastic cap for dispensing liquids from a container, comprising:

a main body adapted to be secured to the container said main body having a recess therein formed with a concave surface and a hole therein, and an upstanding side wall with an upper edge;

a dispensing element having an upper surface and depending side walls being pivotably mounted to the upstanding side walls of the maid body along a pivot axis perpendicular to the central axis of said body, said dispensing element including a depending leg having a convex surface for engaging the concave surface of the main body and a through channel therein, said depending element having a lower portion in the form of a socle, and said through channel extending from an opening in the socle for communicating with the opening in the concave surface to an opening in the depending side wall, said socle having a base surface formed with a layer of soft co-injected plastic material which interacts with the concave surface of the main body to ensure sealing of said dispensing cap, and at least two projections in opposite positions with respect to the hole in the main body for establishing respective opening and closing positions of the cap.

6. The cap according to claim 5 wherein the opening in the concave surface is offset from the central axis and is centered in a plane parallel to the pivot axis and wherein the cap is open in flow communication with the container when the dispensing element is rotated for alignment of the first open end of the channel with the opening and the second open end of the channel is rotated above the edge of the upstanding side wall.

7. A plastic cap for dispensing liquids from a bottle, comprising a cylindrical main body adapted to be secured to the bottle along a central axis, said main body having an upstanding side wall and an upper surface with a concave groove formed therein, said upper surface having a hole formed therein located in the groove;

a dispensing element slidable in the groove and having a side wall portion for engaging the upstanding side wall, said dispensing element being rotatably connected to said body between open and closed positions around an axis perpendicular to the central axis of said body and having an upper part hinged to the main body and a depending portion including a socle formed with a convex surface for conformably engaging the concave groove, said dispensing element formed of a first length extending along the upper part in a first direction and a second length extending along the depending portion in a second direction perpendicular thereto, and having a through channel extending from an opening in the convex surface of the socle to an opening in the side wall portion in the upper part, the convex surface of said socle including a layer of soft material for interacting with the convex surface to ensure the sealing of said dispensing cap; and first and second upstanding projections disposed along a longitudinal axis of the groove within the body, said first and second projections having planar surfaces for engaging the dispensing element in abuting relationship to establish respective opening and closing positions of the cap, and wherein the concave surface is formed with an annular projection surrounding the opening for engaging and deforming the soft material of the socle for establishing a seal at the opening when the cap is closed and for establishing a seal with the through channel when the cap is opened.

8. A cap according to claim 7 wherein the main body is formed of relatively rigid injected polypropylene and the layer of soft material comprises a co-injected, relatively soft plastic material.

9. The cap according to claim 7 further comprising a depending sealing ring formed in the main body for engaging an upper portion of the bottle and for sealing the cap relative to the bottle.

10. A cap according to claim 7 wherein the socle has at least one planar end extending from the convex surface and the dispensing element has a planar surface in an underside of the first length, and the main body includes first and second upstanding projections having corresponding first and second planar surfaces disposed along a longitudinal axis of the groove, said first planar surface of the first upstanding projection for engaging the planar end of the socle in abutting relationship to establish an open position of the cap, and said second planar surface for engaging the planar surface on the underside of the dispensing element to establish a closed position of the cap.

* * * * *